US009803453B2

(12) United States Patent
Kostrov et al.

(10) Patent No.: US 9,803,453 B2
(45) Date of Patent: Oct. 31, 2017

(54) APPARATUS FOR ENHANCED RESONANT OVER-PRESSURED WELL FRACTURING

(71) Applicant: APPLIED SEISMIC RESEARCH CORPORATION, Frisco, TX (US)

(72) Inventors: Sergey Kostrov, Fricso, TX (US); William Wooden, McKinney, TX (US)

(73) Assignee: Applied Seismic Research Corporation, McKinney, TX (US)

( * ) Notice: Subject to any disclaimer, the term of this patent is extended or adjusted under 35 U.S.C. 154(b) by 275 days.

(21) Appl. No.: 14/798,046

(22) Filed: Jul. 13, 2015

(65) Prior Publication Data

US 2017/0016308 A1 Jan. 19, 2017

(51) Int. Cl.
*E21B 43/00* (2006.01)
*E21B 43/26* (2006.01)

(52) U.S. Cl.
CPC ..... *E21B 43/003* (2013.01); *E21B 43/26* (2013.01)

(58) Field of Classification Search
CPC ..... E21B 43/003; E21B 28/00; E21B 43/26; E21B 43/127
See application file for complete search history.

(56) References Cited

U.S. PATENT DOCUMENTS

| | | | | |
|---|---|---|---|---|
| 5,131,472 | A | 7/1992 | Dees et al. | |
| 5,617,921 | A | 4/1997 | Schmidt et al. | |
| 5,669,448 | A | 9/1997 | Minthorn et al. | |
| 6,015,010 | A | 1/2000 | Kostrov | |
| 6,899,175 | B2 * | 5/2005 | Kostrov | E21B 43/003 166/177.1 |
| 7,980,301 | B1 * | 7/2011 | Kostrov | E21B 43/127 166/177.1 |
| 8,459,351 | B2 * | 6/2013 | Kostrov | E21B 43/003 166/177.1 |
| 8,684,076 | B2 * | 4/2014 | Kostrov | E21B 43/126 166/177.1 |
| 9,376,903 | B2 | 6/2016 | Kostrov et al. | |

* cited by examiner

*Primary Examiner* — Michael R Wills, III
(74) *Attorney, Agent, or Firm* — Laubscher, Spendlove & Laubscher, P.C.

(57) ABSTRACT

An apparatus for generating of vibrations for enhancing of forming at least one fracture having a required width r and length L in the formation surrounding a wellbore in the regime of resonance by means of applying vibrations to the formation which is undergoing pressurizing exceeding the fracture gradient pressure of the formation.

1 Claim, 3 Drawing Sheets

APPARATUS FOR ENHANCED RESONANT OVER-PRESSURED WELL FRACTURING

BACKGROUND OF THE INVENTION

The present invention relates to a method for fracturing the earth from a wellbore by over pressuring a fluid(s) and/or gases inside a wellbore under conditions of resonance.

BRIEF DESCRIPTION OF PRIOR ART

Fracturing the earth from a wellbore is a known technique for enhancing oil production and recovery from an oil bearing bed. A variety of methods and apparatuses have been proposed to create both short and long fractures near a wellbore. One of these is described and claimed in U.S. Pat. No. 5,617,921 by Schmidt et al., herein incorporated by reference, wherein a method for initiating and/or extending a fracture in an earth's formation from a well penetrating the formation utilizing a source of high pressure fracturing fluid disposed on the earth's surface which is released to flow into and through the well at a predetermined time to initiate and/or extend the fracture. However, this method requires a significant amount of energy and to have a relatively large diameter tubing string in which to hold a sufficient charge of pressured gas to provide an adequate fracture fluid pressure and flow characteristics.

The use of high pressured gas or other pressured fluid(s) in a wellbore to clean perforations and/or create fractures has been described in U.S. Pat. Nos. 5,669,448 and 5,131,472, herein incorporated by reference. These references disclose a system of stimulating a well by suddenly applying pressure to the formation in excess of the fracture gradient pressure and thereafter pumping fluid into the well before the pressure declines below the fracture gradient pressure. In addition, there are other more expensive means of injecting treatment liquids that have been proposed. One such type of approach is to place the treatment liquid in the well and ignite a gas generating propellant in the production string, as shown in U.S. Pat. Nos. 6,138,753; 5,443,123; 5,145,013; 5,101,900; 4,936,385 and 2,740,478, herein incorporated by reference. Of more general interest is the disclosure in U.S. Pat. No. 3,029,732, herein incorporated by reference.

While there have been a variety of methods proposed for creating hydraulic fractures around the wellbore, there remains a need for an effective, high-pressure method which creates a pattern of fractures extending from all perforations into the formation in particular with the required parameters of fractures.

SUMMARY OF THE INVENTION

Accordingly, a primary object of the present invention is to provide an apparatus for enhancing of forming at least one fracture having a required width r and length L in the formation surrounding a wellbore in the regime of resonance which includes a flow line at the surface supplying a fracturing fluid from a tank via a pump into the wellbore and a flow line having a check valve preventing flow of fracturing fluid from the wellbore back into the flow line, a tubing string connected to the flow line and extending downwardly into the wellbore, an elongated cylinder connected to the bottom of tubing string at the upper end and having an opening to wellbore, a plunger movably arranged within an elongated cylinder to move within the elongated cylinder and having a taper on a lower end of said plunger, the pumping means, accommodated inside a lubricator to prevent the leakage of the fracturing fluid from the tubing and the flow line at the surface, and connected with plunger for moving of said plunger within the elongated cylinder and compressing the fracturing fluid contained between check valve inside the flow line and plunger inside the elongated cylinder and discharging said fracturing fluid into the wellbore via an opening when said plunger exits out of the elongated cylinder on every upstroke of pumping means to generate a vibrations on resonant frequency, and an angle θ of taper on lower end of said plunger is determined by the following expression:

$$\theta = \frac{1}{3}\arccos ine\left[-\frac{(1-\varphi)ShL_s(D_1^2-d_r^2)}{2f_r\Delta t D_1^3}\right],$$

where θ is the angle of taper on lower end of the plunger, ϕ is a slippage of fracturing fluid between the elongated cylinder and plunger, Sh is Strouhal number, $L_s$ is the length of stroke of the pumping means, $D_1$ is the diameter of plunger, $d_r$ is the diameter of pumping means, $f_r$ is the resonant frequency, Δt is the discharging time of compressed liquid.

It is another object of the present invention to provide an apparatus for enhancing of the formation fracturing around a wellbore in the regime of resonance in which the length l of said taper on the lower end of plunger is determined by the following expression:

$$0.1D_1 \le l \le \frac{D_1}{2tg\theta},$$

where l is length of taper on the lower end of plunger, $D_1$ is the diameter of plunger, θ is the angle of taper on lower end of the plunger and tg is the trigonometric function tangent.

DETAILED DESCRIPTION

Figure 1:
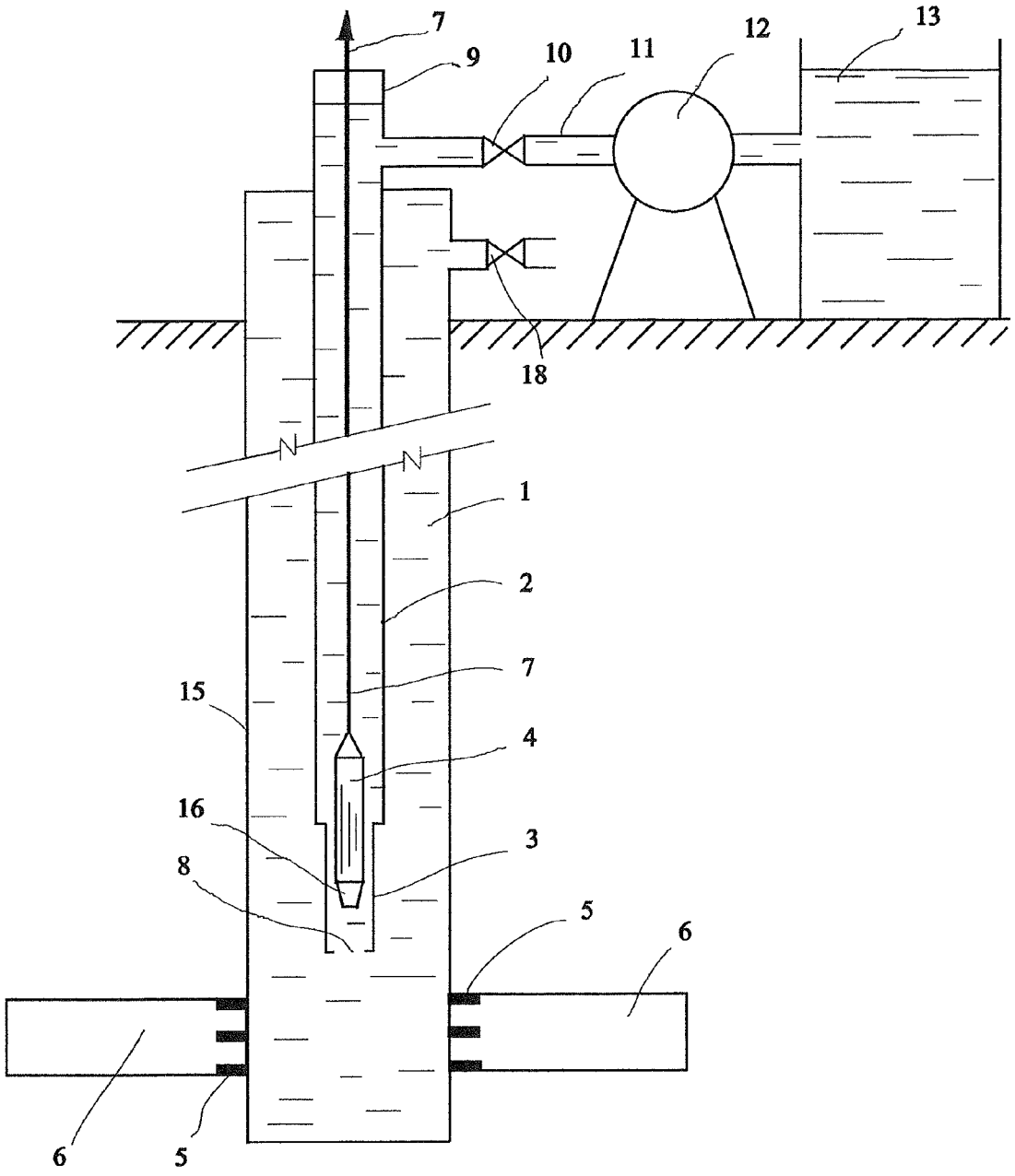
FIG. 1 shows a schematic illustration of the wellbore in which the method and the apparatus of the present invention is employed.
Figure 2:
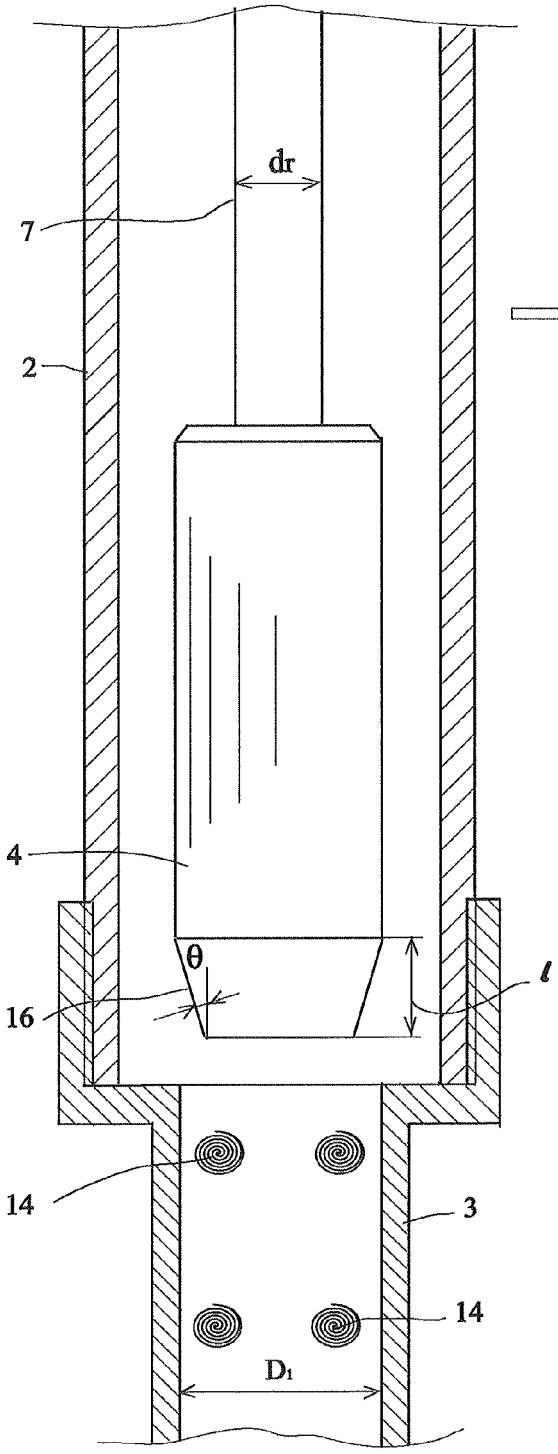
FIG. 2 is a cross-sectional side view of the apparatus for practicing the present invention.

Referring to FIG. 1 and FIG. 2, there is shown the wellbore 1 having perforations 5 and fractures 6. FIG. 1 shows a general arrangement of a device for generating vibrations and procedure using the vibrations, the flow line 11 at the surface supplying the pressurized fracturing fluid from tank 13 via pump 12 into wellbore 1, the check valve 10 which is closed when the pressure of fracturing fluid inside the tubing 2 is greater than the one in flow line 11 thereby preventing flow of fracturing fluid from the tubing 2 back into the flow line 11, the tubing string 2 connected to flow line 11 and extending downwardly into the wellbore 1, a device for generating vibrations consisting of the elongated cylinder 3 connected with the bottom of tubing string 2 at the upper end and having the opening 8 to wellbore 1, the plunger 4 having the taper 16 movably arranged within the elongated cylinder 3 to move within said elongated cylinder 3, the pumping means 7 (for instance, sucker rods which, in turn, are connected to pumping unit) connected with the plunger 4 for moving the plunger 4 within the elongated cylinder 3 and compressing the fracturing fluid contained between the check valve 10 inside the flow line 11 and plunger 4 inside the elongated cylinder 3 and discharging the compressed fracturing fluid into the wellbore 1 via the opening 8 when plunger 4 exits out of the elongated cylinder 3 on every upstroke of the pumping means 7 to generate the vibrations due to the creating a periodic vortices 14 (FIG. 2) in accordance with well known phenomenon of an auto-oscillations discovered by V. Strouhal in $19^{th}$ century. A lubricator 9 accommodates a pumping means 7 to prevent the leakage of the compressed fracturing fluid from the tubing string 2 and flow line 11 at the surface. More details about phenomenon of auto-oscillations could be found in U.S. Pat. No. 9,376,903,herein incorporated by reference.

The generation of vibrations is repetitive and occurs in the form of bursts or so called hydro-impact waves/pulses at the moment when plunger 4 exits out of the elongated cylinder 3 due to the upward motion of the pumping means 7. The pumping means 7 provide a reciprocating upward and downward movements of the plunger 4 inside the elongated cylinder 3. The number or rate of reciprocating movements may vary from a few per hour to a dozens per minute depending on the particular fracturing operation.

Figure 3:
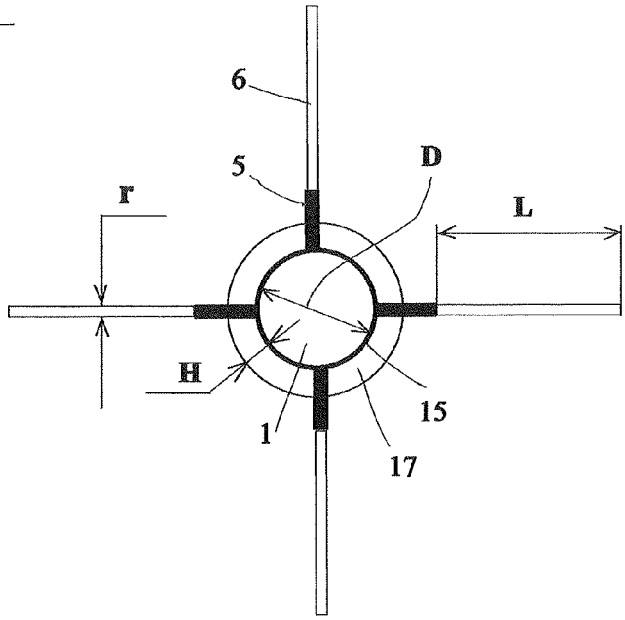
FIG. 3 is a cross-sectional top view of the wellbore and the formation with the fractures.
Figure 4:
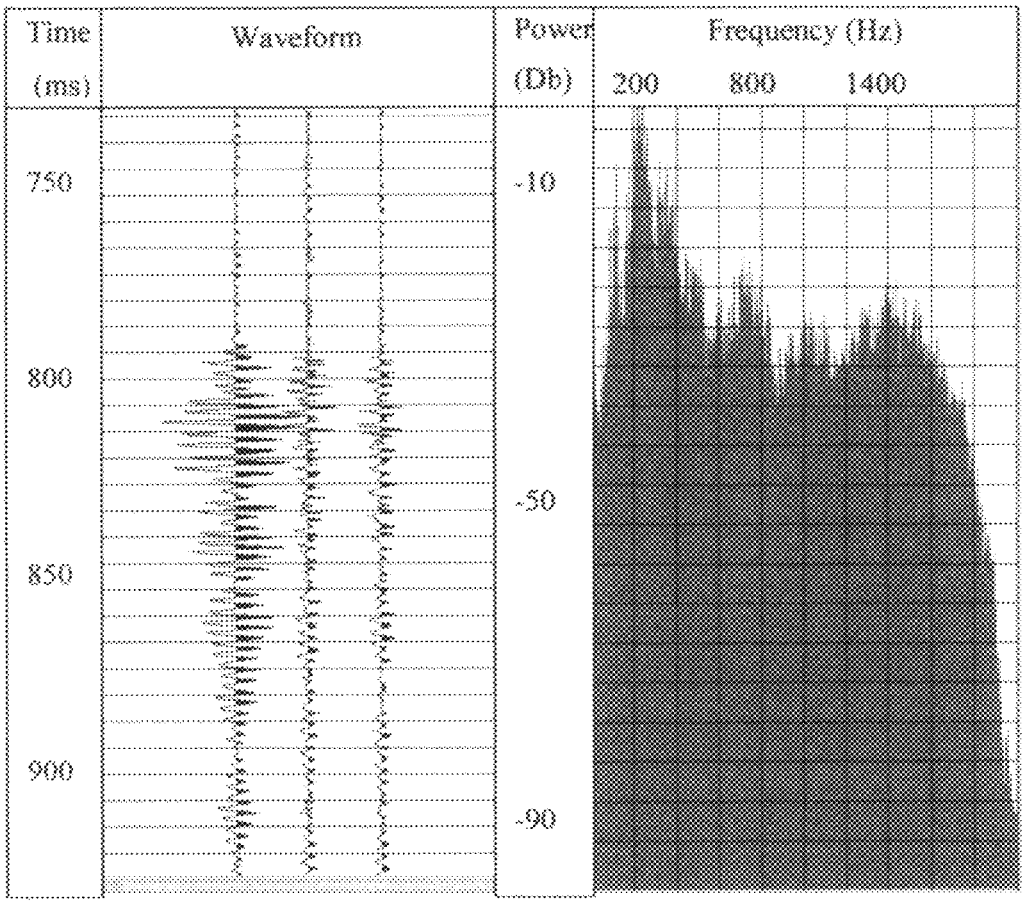
FIG. 4 is a waveform and spectrum of a single burst/pulse provided by device for generating vibrations.

The typical measured waveform of a single burst and corresponding spectrum are shown on FIG. 4. The diagram/waveform on the left part of FIG. 4 shows the signal from device for generating vibrations recorded by a geophone and two geophones, namely, horizontal and vertical ones in the offset well located on the distance of 1385 feet from the well wherein the device for generating vibrations was installed. The duration of the bursts accounts for 40-100 milliseconds depending on pressure of the compressed fracturing fluid between the plunger 4 and the check valve 10. A main or resonance frequency of generated vibrations can be "moved" along the frequency axis to the left or right on the spectrum diagram by providing the device for generating vibrations having an ability to create vibrations on a particular resonant frequency, i.e. the frequency matching so called eigen frequency of fractures with predetermined or required width r and length L (FIG. 3). As it is seen from FIG. 4 the amplitude of the resonant frequency is by about 30-50 times higher compared with the rest of frequencies in spectrum (the units on vertical axis are in decibels). The check valve 10 installed on a flow line 11 could have a simple design having a seat with round hole in the center of said seat and a ball having bigger diameter and matching said hole in such manner that when the pressure of fracturing fluid in front of ball is greater than behind the one the ball closes said round hole of said seat thereby preventing any backward flow of fracturing fluid from flow line 11 into the tank 13. It should be noted that valve 18 during fracturing has to be either closed or at least one standard packer (not shown) is installed between tubing 2 and casing 15 above the perforations 5.

FIG. 3 shows the cross-sectional top view of the wellbore 1, a casing 15, cement bond 17, and the formation with the perforations 5 and the fractures 6. The eigen, natural or resonant frequency of such fractures (or slots in acoustics) is determined by the following formulae:

$$f_r = \frac{c}{2\pi}\sqrt{\frac{r}{1.2HL(r+W)}},$$

where $f_r$ is the frequency of resonance, c is a speed of sound in the fracturing fluid, π equals 3.1415, r is the required width of fracture 6, H is the combined thickness of the casing 15 and the cement bond 17 surrounding the casing, L is the required length of fracture 6, W is a length of the a casing arch between two neighboring perforations 5. In particularly, for fracturing event shown on FIG. 3 (four fractures 6) W=πD/4, where D is the diameter of the casing 15. Thus, in order to get the fracture(s) 6 with particular parameters, i.e. the required width r and length L, the affecting vibrations have to be supplied on corresponding resonant frequency. For instance for the following parameters: r=0.02 m, H=0.05 m, L=100 m, W=0.13 m (corresponds to 7.0 inch casing and four fractures), c=1600 msec (corresponds to 70 MPa hydrostatic pressure under 20° C. temperature in wellbore) the resonant frequency equals 38 Hz. It should be noted that under conditions of resonance the fractures 6 will have predetermined, required width r and length L. It's important from the point of view of fracturing process when in case of too wide width r the excessive usage of proppant could be prohibitively expensive, and the fracture having too long length L can reach the highly water saturated sublayer of formation leading to the production of excessive portion of water instead of oil or gas from fractured well.

To generate the vibrations on resonant frequency the device for generation of vibrations in accordance with present invention has to have the corresponding angle θ of taper 16 (FIG. 2) on the lower end of said device determined in accordance with the following formulae:

$$\theta = \frac{1}{3}\arccos ine\left[-\frac{(1-\varphi)ShL_s(D_1^2-d_r^2)}{2f_r\Delta t D_1^3}\right],$$

where θ is the angle of taper on lower end of the plunger, φ is a slippage of the fracturing fluid between the elongated cylinder and plunger (no dimensional), Sh is Strouhal number, $L_s$ is the length of stroke of the pumping means, $D_1$ is the diameter of plunger, $d_r$ is the diameter of pumping means, $f_r$ is the resonant frequency, Δt is the discharging time of compressed liquid.

For instance for the following parameters: $D_1$=0.08255 m, φ=0.1, Sh=0.21, $d_r$=0.0254 m, $L_s$=2.8 m, Δt=0.25 sec and resonant frequency $f_r$=38 Hz the corresponding angle θ of taper 16 equals $36^0$, meanwhile the length l of taper 16 on the lower end of plunger 4 is determined by the following expression:

$$0.1D_1 \le l \le \frac{D_1}{2tg\theta},$$

where l is length of taper on the lower end of plunger, $D_1$ is the diameter of plunger, θ is the angle of taper on lower end of the plunger and tg is the trigonometric function tangent.

Thus for above noted parameters ($D_1$=0.08255 m and θ=$36^0$) the length l of taper 16 can vary in the range of 0.008255 m to 0.05681 m depending on particular design of elongated cylinder 3.

As an alternative source of the said vortices generating vibrations on resonant frequency, for instance, can be used the devices described in U.S. Pat. Nos. 8,459,351, 6,015,010 and 6,899,175, herein incorporated by reference.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. An apparatus for enhancing of forming at least one fracture having a required width r and length L in a formation having a wellbore penetrating said formation and communicating therewith through a multiplicity of perforations by providing vibrations on a resonant frequency and comprising:

a) a flow line at the surface supplying a fracturing fluid into the wellbore and said flow line has a check valve preventing a flow of said fracturing fluid from the wellbore back into said flow line;

b) a tubing string connected to said flow line and extending downwardly into the wellbore;

c) an elongated cylinder connected to a bottom of the tubing string at an upper end and having an opening to the wellbore;

d) a plunger having a taper at a lower end and movably arranged within said elongated cylinder to move within said elongated cylinder;

e) a pumping means connected with said plunger for moving of said plunger within said elongated cylinder and compressing the fracturing fluid contained between said check valve inside the flow line and said plunger inside the elongated cylinder and discharging the compressed fracturing fluid into the wellbore via said opening when said plunger exits out of said cylinder on every upstroke of said pumping means to generate vibrations;

f) a lubricator accommodating the pumping means to prevent a leakage of the fracturing fluid from the tubing and flow line at the surface;

g) and said taper at the lower end of said plunger has an angle determined by the following formulae:

$$\theta = \frac{1}{3}\text{arccos}ine\left[-\frac{(1-\varphi)ShL_s(D_1^2-d_r^2)}{2f_r\Delta tD_1^3}\right],$$

where θ is the angle of taper on lower end of the plunger, ϕ is a slippage of the fracturing fluid between the elongated cylinder and the plunger, Sh is Strouhal number, $L_s$ is a length of the upstroke of the pumping means, $D_1$ is a diameter of the plunger, $d_r$ is the diameter of the pumping means, $f_r$ is the resonant frequency, Δt is the discharging time of compressed fracturing fluid, wherein said taper at the lower end of said plunger has a length L determined by the following expression:

$$0.1D_1 \le L \le \frac{D_1}{2tg\theta},$$

where L is the length of the taper on the lower end of the plunger, $D_1$ is the diameter of plunger, θ is the angle of taper on the lower end of the plunger and tg is the trigonometric function tangent.

* * * * *